US006598784B2

(12) United States Patent
LaBras et al.

(10) Patent No.: US 6,598,784 B2
(45) Date of Patent: Jul. 29, 2003

(54) BEVERAGE CARTON WITH STRAP TYPE CARRYING HANDLE

(75) Inventors: Philippe LaBras, FChateauroux (FR); Jean-Michel Auclair, Chateaurouc (FR)

(73) Assignee: MeadWestvaco Packaging Syatens, LLC, Stamford, CT (US)

( * ) Notice: Subject to any disclaimer, the term of this patent is extended or adjusted under 35 U.S.C. 154(b) by 0 days.

(21) Appl. No.: 10/177,364

(22) Filed: Jun. 20, 2002

(65) Prior Publication Data

US 2003/0015579 A1 Jan. 23, 2003

Related U.S. Application Data

(63) Continuation of application No. PCT/US00/34712, filed on Dec. 20, 2000.

(51) Int. Cl.[7] ..... B65D 5/46

(52) U.S. Cl. ..... 229/117.22; 229/117.24; 229/920

(58) Field of Search ..... 229/117.22, 117.23, 229/117.24, 117.25, 117.26; 206/428

(56) References Cited

U.S. PATENT DOCUMENTS

| | | | | |
|---|---|---|---|---|
| 1,141,789 | A | | 6/1915 | Freese |
| 2,158,697 | A | | 5/1939 | Harrison |
| 2,645,406 | A | | 7/1953 | Robins |
| 2,682,990 | A | | 7/1954 | Crary |
| 2,760,716 | A | | 8/1956 | Weiner |
| 2,783,690 | A | | 3/1957 | Crary |
| 2,797,856 | A | | 7/1957 | Jaeschke |
| 2,955,739 | A | | 10/1960 | Collura |
| 3,076,591 | A | | 2/1963 | Nute et al. |
| 3,315,876 | A | | 4/1967 | Vander Jagt |
| 3,774,836 | A | | 11/1973 | Nunn |
| 3,801,012 | A | | 4/1974 | Thelen |
| 4,166,570 | A | | 9/1979 | Lazerand et al. |
| 4,286,714 | A | | 9/1981 | Zdarsky et al. |
| 4,498,619 | A | | 2/1985 | Roccaforte |
| 4,546,914 | A | | 10/1985 | Roccaforte |
| 4,583,681 | A | | 4/1986 | Neese |
| 4,860,944 | A | * | 8/1989 | Wonnacott ..... 206/428 |
| 5,328,081 | A | | 7/1994 | Saulas |
| 5,639,017 | A | | 6/1997 | Fogle |
| 5,704,540 | A | | 1/1998 | Coalier et al. |
| 5,738,273 | A | | 4/1998 | Auclair |
| 5,878,946 | A | * | 3/1999 | Frerot et al. ..... 229/117.22 |
| 5,915,546 | A | * | 6/1999 | Harrelson ..... 206/428 |
| 5,992,733 | A | | 11/1999 | Gomes |

FOREIGN PATENT DOCUMENTS

| | | | |
|---|---|---|---|
| DE | 7901421 | U1 | 4/1979 |
| EP | 0098903 | A1 | 1/1994 |
| EP | 0813486 | B1 | 5/1999 |
| GB | 1240549 | | 7/1971 |
| GB | 2234495 | A | 2/1991 |
| GB | 2252958 | A | 8/1992 |
| WO | WO 96/20874 | A1 | 7/1996 |
| WO | WO 96/20881 | A1 | 7/1996 |
| WO | WO 97/07031 | A1 | 2/1997 |
| WO | WO 99/44898 | A2 | 9/1999 |
| WO | WO 00/038998 | A3 | 7/2000 |

* cited by examiner

*Primary Examiner*—Gary E. Elkins
(74) *Attorney, Agent, or Firm*—Tsugihiko Suzuki

(57) ABSTRACT

A carton and a carton blank each includes a first wall, a second wall hingedly connected to the first wall, a handle strap attached at an end thereof to an inwardly displaceable portion of the second wall. The strap is arranged in a stored position to be in substantially co-planar relationship with the first wall, wherein inward displacement of the inwardly displaceable portion provides a surplus of material to enable the user part of the strap to be brought into a position of use.

19 Claims, 15 Drawing Sheets

BEVERAGE CARTON WITH STRAP TYPE CARRYING HANDLE

This is a continuation of international application No. PCT/US00/34712, filed Dec. 20, 2000, which is hereby incorporated by reference.

BACKGROUND OF THE INVENTION

This invention relates to a carton which is particularly but not only suitable for accommodating beverage containers such as cans and bottles and which incorporates a "strap-type" carrying handle.

Beverage cartons which include carrying handles and indeed, strap type carrying handles are known. For example, U.S. Pat. No. 4,166,570 (Lazerand et al.) discloses a packaging carton for beverage cans which a strap type handle. The handle strap has a central user portion exposed to view in a handle access aperture in top wall of the carton, extends across the top wall and has opposite ends which terminate in respective ones of a pair of end closure flaps which are hinged to the top wall. The handle strap is reinforced by a separate strip of reinforcing material, for example, a fibrous tape.

WO 97/07031 (Riverwood International Corporation) discloses a packaging carton for beverage cans having a handle strap secured at each end thereof to an outer face of an end panel of the carton between a pair of cuts which extend across the hinge between the top panel and the respective end panel. As the carton is lifted via the handle, the provision of a fold line extend between the pairs of cuts on the top panel allows the portions bounded by the cut lines to deflect inwardly.

It is an object of the invention to provide a multiply handle that does not protrude above the top panel in a stored position and that can be deployed to a position of use.

SUMMARY OF THE INVENTION

The present invention has sought to overcome or at least mitigate the problems of the prior art.

One aspect of the invention provides a carton for accommodating at least one article, the carton comprising a first wall, a second wall hingedly connected to the first, a handle strap attached at an end thereof to an inwardly displaceable portion of the second wall. The strap is arranged in a stored condition to be in substantially co-planar relationship with the first wall, wherein inward displacement of the portion from a stored condition in a substantially co-planar relationship with the second wall provides a surplus of material to enable the user part of the strap to be brought into a position of use. Preferably, the inwardly displaceable portion may be a tab struck from the second wall.

In one embodiment, the tab may be defined by cut lines that converge towards a fold line hingedly interconnecting the first and second walls.

Alternatively, the tab may be defined by substantially parallel fold lines that intersect with a fold line hingedly interconnecting the first and second walls.

According to an optional feature of this aspect of the invention, the user part of the handle strap may be arranged so as to be accessible via an aperture provided in the first wall.

According to another optional feature of this aspect of the invention, the carton may comprise a third wall hingedly connected to an opposite edge of the first panel from the second wall. Preferably, the third wall may comprise a second inwardly displaceable portion. More preferably, the second inwardly displaceable portion may be a tab. Optionally, the first and second inwardly displaceable portions may be formed integrally with an elongate strip detachable from, and extending across the first panel. Preferably, the strap may be secured to at least part of the strip, and is co-extensive therewith.

According to another optional feature of this aspect of the invention, a second ply of material may overlie at least part of the inwardly displaceable portion. Preferably, the strap may be disposed between the inwardly displaceable portion and the second ply of material. More preferably, the second ply of material may comprise a further inwardly displaceable portion.

In one class of embodiments, the end of the strap may be disposed between inner and outer of the inwardly displaceable portions.

Alternatively, the inner and outer displaceable portions may be secured together and the strap is secured to one of the portions.

According to a further optional feature of this aspect of the invention, the first wall may be a composite of first and second at least partially lapped panels. Preferably, the lapped portion of the first panel may have the handle strap secured thereto.

According to a still further optional feature of this aspect of the invention the second ply may be a separate insert secured to the carton.

According to yet another optional feature of this aspect of the invention, a blinding panel may be arranged so as to substantially prevent access to the interior of the carton through the aperture. Preferably, the blinding panel may be hingedly connected to a first panel of the first wall.

More preferably, the blinding panel may be formed from a separate blank secured over the aperture.

BRIEF DESCRIPTION OF THE DRAWINGS

Exemplary embodiments of the invention will now be described, by way of example only, with reference to the following drawings in which.

DETAILED DESCRIPTION OF THE PREFERRED EMBODIMENTS

Figure 1A:
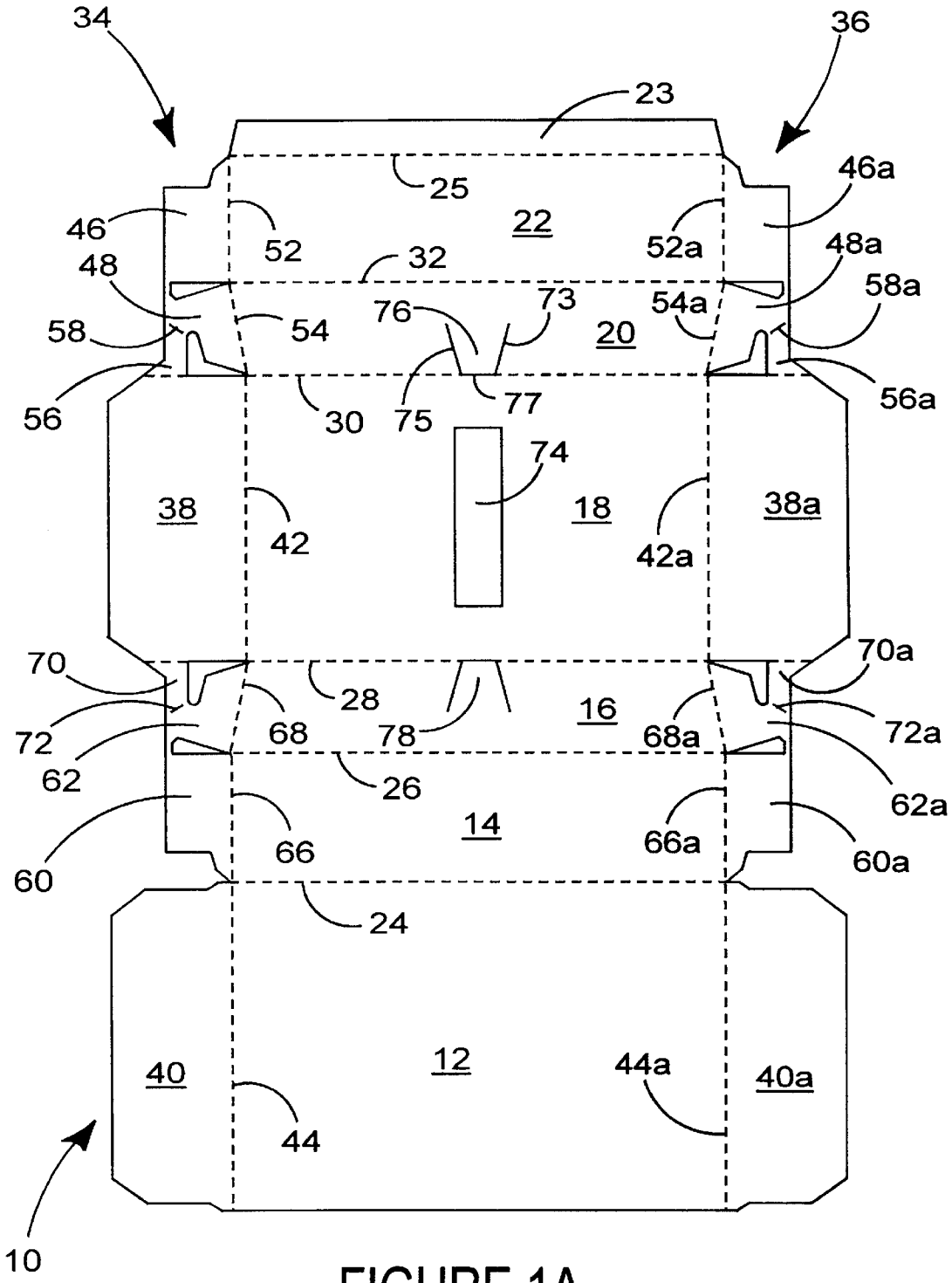
FIG. 1A is a plan view of a blank of a fully enclosed carton according to one embodiment of the invention.

Referring to the drawings, and in particular FIGS. 1A, 1B, 1C, 6, 10, 13 and 17 thereof, a carton is formed from a two-part or unitary blank 10, 80, 90, 110, 210, 310, 410 made from paperboard or other suitable foldable sheet material, which can be adapted to accommodate a variety of articles, for example twelve bottles arranged in three rows of four bottles each. It is envisaged the carton can be adapted to accommodate a different number of bottles or other articles according to user requirements.

Turning to the first embodiment of the carton blank 10 illustrated in FIG. 1A, this blank includes a first base panel 12, a first side wall panel that may comprise lower side panel 14 and upper side panel 16, top panel 18, and a second side wall panel that may comprise second upper panel 20, and a second lower side panel 22. The aforesaid panels are hingedly connected one to the next in a longitudinal plane along fold lines 24, 26, 28, 30 and 32 respectively. A securing flap 23 may be hingedly connected to one end of the blank, for example the second lower side panel 22 along fold line 25. In alternative embodiments, other securing arrangements may be used.

Preferably, the blank further comprises an end closure structure indicated generally by numeral 34 including a pair of upper and lower end closure panels 38, 40 hingedly connected to top panel 18 and base panel 12, along fold lines 42 and 44 respectively.

In one class of embodiments, the end closure structure 34 further includes connected together gusset panels 46 and 48. Gusset panels 46, 48 extend outwardly from lower and upper side panels 22, 20 respectively and are connected thereto by fold lines 52, 54. A further overlapping panel 56 is connected to end panel 38 by lateral fold line 30 and to gusset panel 48 along fold line 58. The gusset panels 46, 48 and overlapping panel are adapted to form a corner structure as is well known in the art.

Likewise, the opposing corner of the end closure structure 34 also includes gusset panels 60 and 62. Gusset panels 60, 62 extend outwardly from lower and upper side panels 14, 16 and are connected thereto by fold lines 66, 68. A further overlapping panel 70 is connected to end panel 38 by lateral fold line 28 and to gusset panel 62 along fold line 72.

It is envisaged that there may comprise one or more end closure structures without departing from the scope of the invention.

The construction along the opposing side of the top panel and bottom comprises an end closure structure 36 which is similar and therefore like parts at one end of the top panel are designated by reference numerals to like parts of the opposite end with the addition of suffix 'a' and are not described in any greater detail.

Turning to the construction of the handle structure, there comprises a central user aperture 74 struck from top panel 18. In this embodiment, the central user aperture 74 is substantially rectangular in shape.

An outer displaceable tab 76 is struck from the blank in the second upper side panel 20 so that the flap 76 is hinged to that panel, but otherwise cut out from the blank along cut lines 73, 75 and 77. Cut lines 73 and 75 preferably converge towards cut line 77. Cut line 77 is, in this embodiment, arranged to interrupt fold line 30 although in alternative embodiments this is not necessarily the case. Likewise, a second flap 78 is struck from the first upper side panel 16 and is hingedly connected thereto by a similar arrangement. The first and second flaps are, preferably, located substantially in line with the longitudinal axis of the aperture 74.

The other features of the handle structure are described by reference to FIG. 1B, in which there is shown a second blank 80 arranged to be secured to the first blank 10. The blank comprises in series a first side panel 84, a top panel 86 and a second side panel 88 hingedly interconnected along interrupted fold lines 85 and 87. A displaceable tab 83 that may advantageously be of substantially identical dimensions to tab 76 on blank 10 is struck from, and hingedly interconnected to, second side panel 88, and is preferably defined by convergent cut lines 59 and 61 and an aperture H2. A similar flap 81 is likewise struck from first side panel 84 and is defined in part by aperture H1. A plurality of apertures 89 may additionally interrupt fold lines 85 and 87 and are preferably used to aid the manipulation of the blank 80. A handle strap 82 is preferably glued at glue point G to the first and second side panels 84 and 88, and to flaps 81 and 82, and is arranged to extend across upper panel 86, as shown.

Figure 1B:
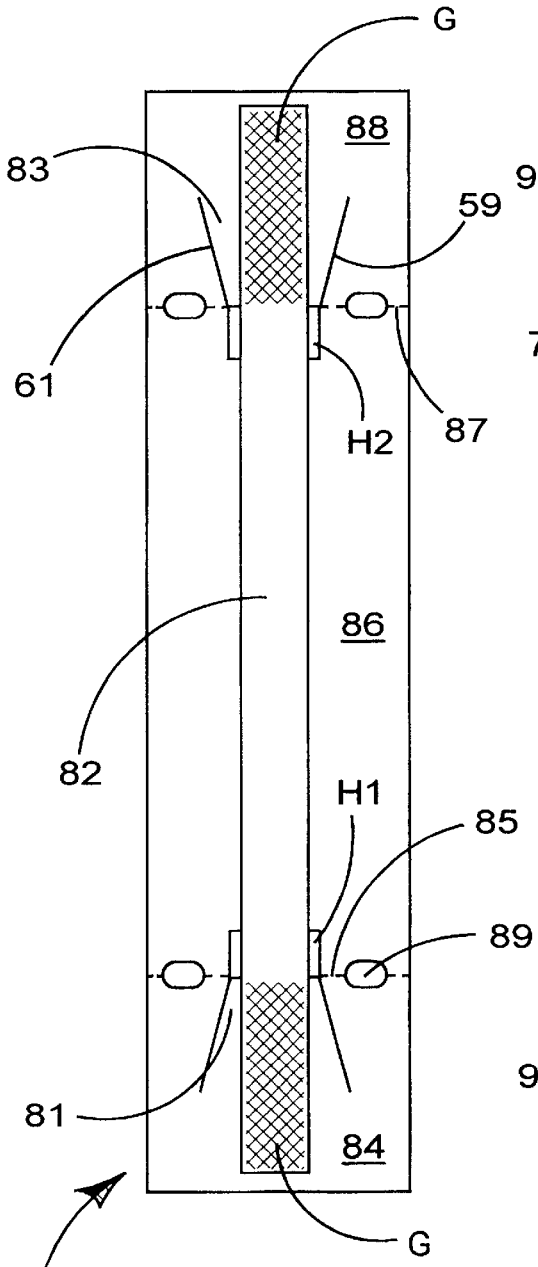
FIG. 1B is a plan view of an insert blank which may be secured to the blank of FIG. 1A.
Figure 1C:
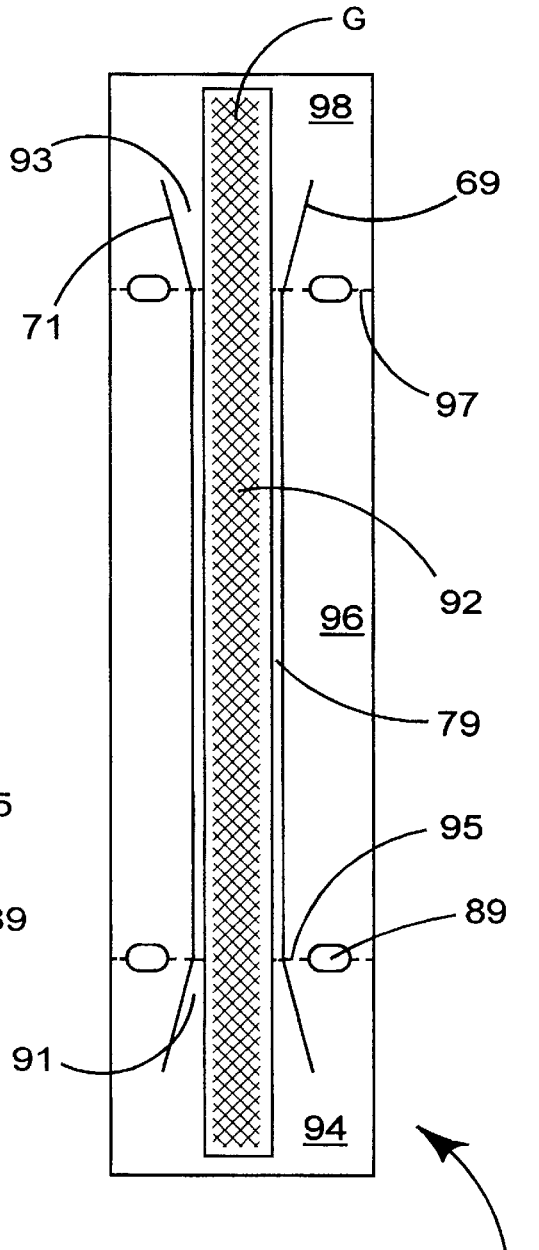
FIG. 1C is a plan view of an alternative insert blank which may be secured to the blank of FIG. 1A.

FIG. 1C illustrates an alternative embodiment of the insert blank. The blank 90 comprises a first side panel 94, a top panel 96 and a second side panel 98 hingedly interconnected in series along interrupted fold lines 95 and 97. As in blank 80, opposed tabs 91 and 93 are struck from the first and second side panels respectively, but are interconnected by an elongate strip 79 struck from the top panel 96 and extending between fold lines 95 and 97. Tab 93 is defined by convergent cut lines 69 and 71, and tab 91 is preferably similarly arranged. A handle strap 92 is preferably secured by glue at glue point G to first and second side panels 94 and 98, elongate strip 79, and tabs 91 and 93. In alternative embodiments, other securing means known in the art may be used.

It is preferred that the handle strap 82, 92 of FIGS. 1B and 1C is formed from paperboard, laminated paperboard, fibrous tape or other suitable plastics material capable of supporting the weight of the carton and its contents.

Figure 2:
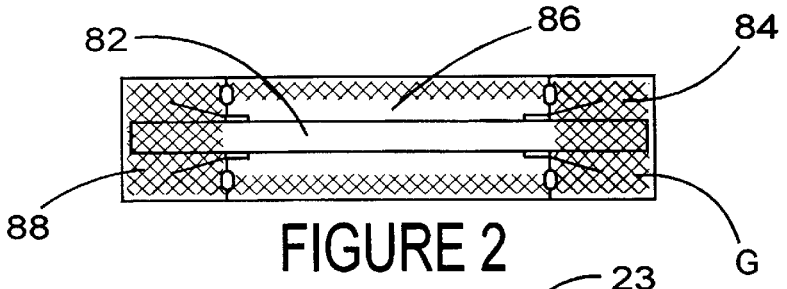
FIG. 2 is a plan view of the blank shown in FIG. 1B with glue applied thereto.
Figure 3:
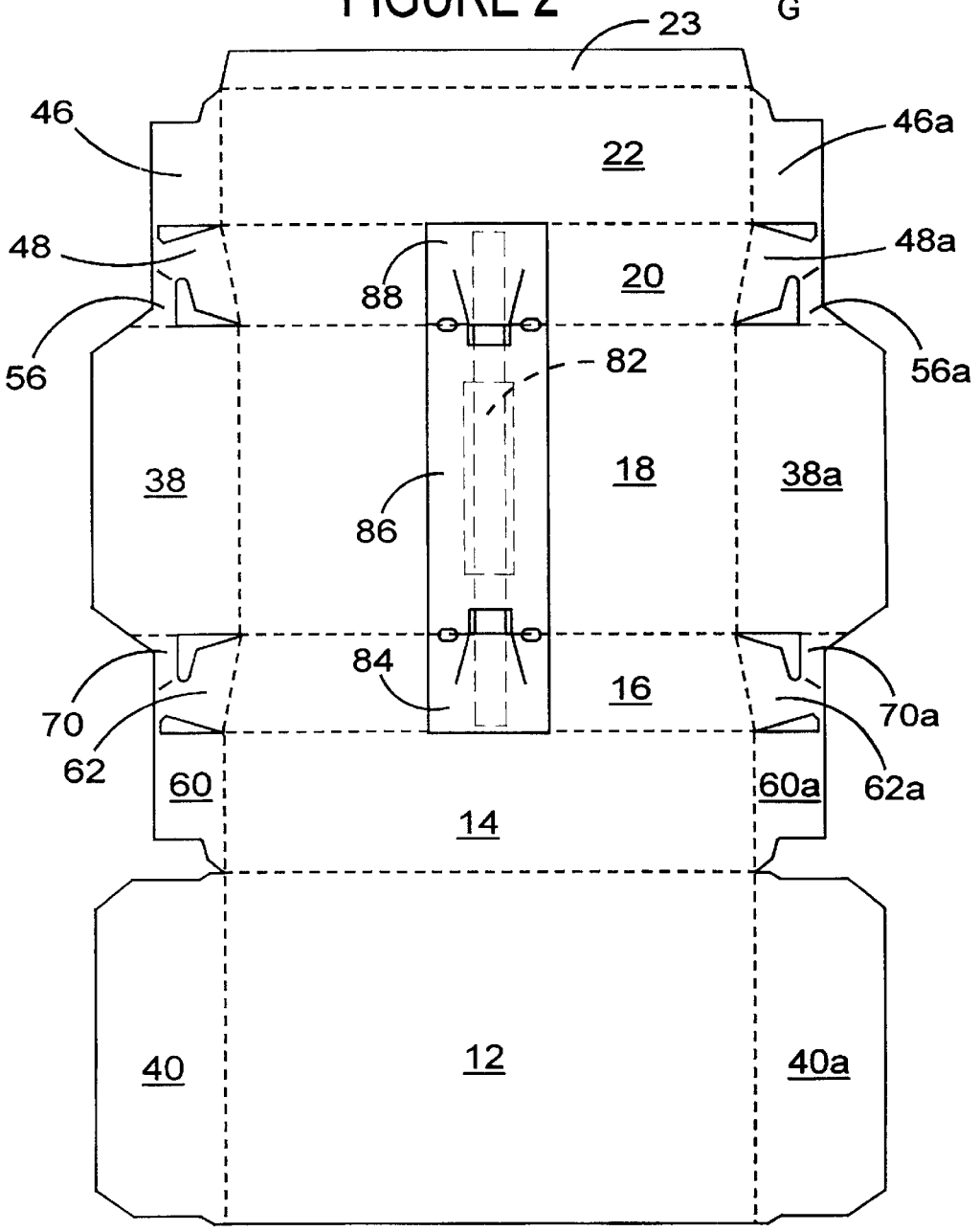
FIG. 3 is a plan view of the blank of FIG. 1A in which the blank of FIG. 1B has been secured thereto.

Turning now to FIGS. 2 and 3, glue is applied preferably at glue point G to the insert blank 80, and the insert is then secured to blank 10 in the position illustrated in FIG. 3 such that inner tab 81 overlies outer tab 78, inner tab 76 overlies outer tab 83, and the strap 82 is secured therebetween. In other embodiments, glue may be applied to blank 10 rather than the insert blank 80. The strap 82 is preferably visible through user aperture 74. In an alternative embodiment, insert 90 may alternatively be secured to blank 10 in a similar manner such that the strap 92 and/or strip 79 handle is visible through the aperture 74.

Figure 4:
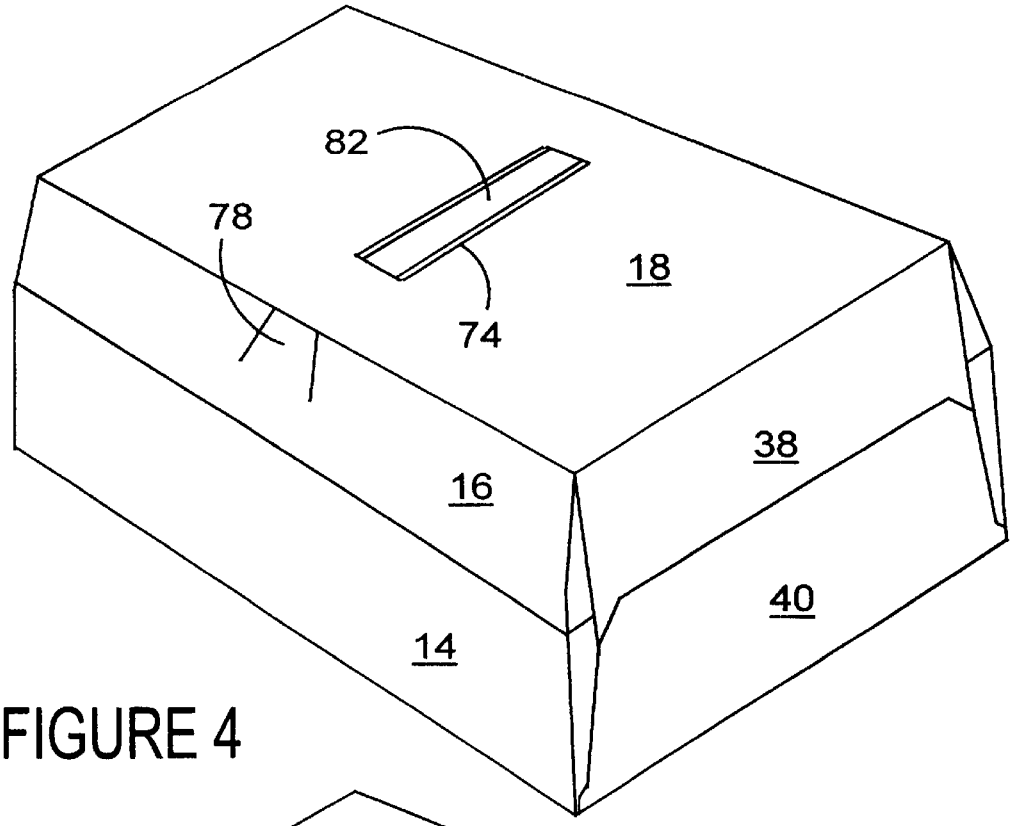
FIG. 4 is a perspective view of a carton formed from the blank shown in FIG. 1.
Figure 5:
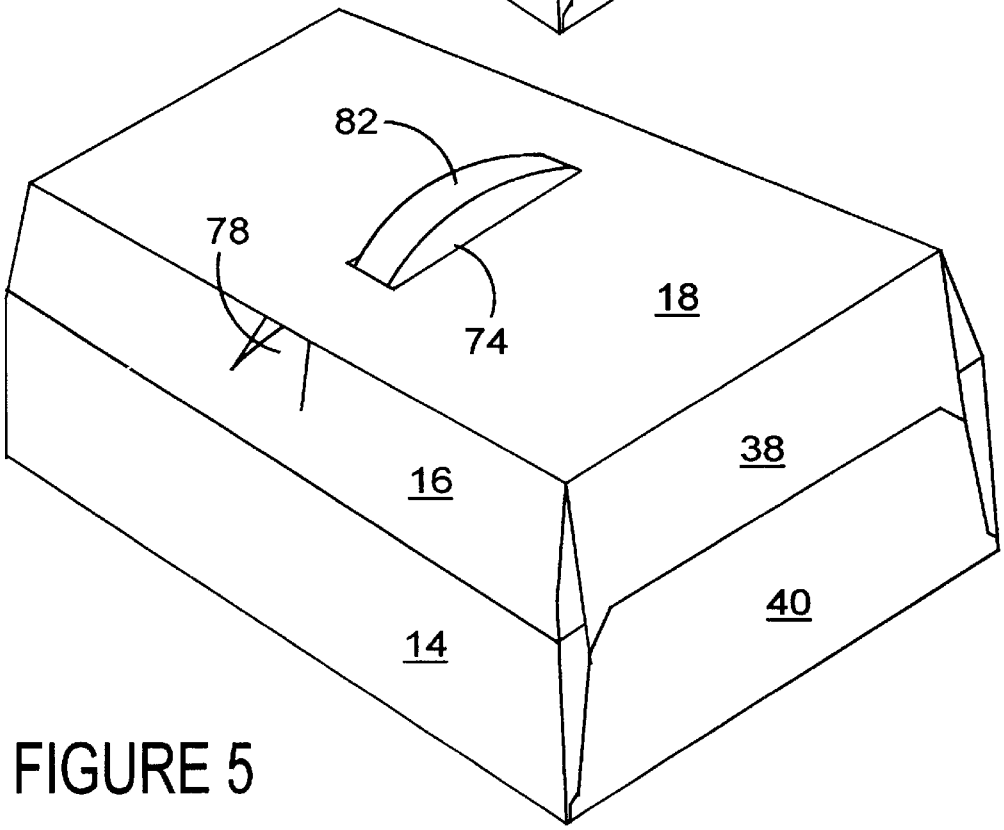
FIG. 5 is a perspective view of the carton shown in FIG. 3 illustrating the handle structure in a set up condition.

Turning now to the construction of the carton illustrated in FIGS. 4 and 5, the blanks require a series of sequential folding and/or gluing operations which are preferably performed in a straight line machine so that the carton is not required to be rotated or inverted to complete its construction. The folding process is not limited to that described below and can be altered according to particular manufacturing requirements.

The carton is usually supplied to a bottler in a flat collapsed tubular condition whereby lower side panel 22 is secured to base panel 12 by securing glue flap 23 using glue or other suitable means. In order to set up the carton, the sides, top and base panels are folded from a flat condition to form a tubular structure, as is well known.

Thereafter, articles are introduced into the carton and the end closure structure is formed. Gusset panels 46, 48, 50 and 60, 62, 70 are folded inwardly about fold lines 52, 54 and 66, 68 respectively and the end closure panels 38, 40 are folded inwardly to form one end of the sleeve, whereby the gusset panels come into face to face relationship with end closure panels 38 and 40. Panels 56, 70 come into face to face contact with their respective adjacent gusset panels 48, 62. Optionally, the faces of gusset panels 46, 48, 60, 62 may be secured to the upper and lower end closure panels 38, 40 by means known in the art to hold the end closure panels in place. The opposing end structure 36 is formed in like manner, so the carton is in a set up and loaded condition as shown in FIG. 4.

In order to bring the handle to a position of use as illustrated in FIG. 5, the user part of the strap 82 is accessed via the user aperture 74, and may be pulled so as to stand proud of the top panel 18. Composite flaps 76, 83, and 78, 81 deflect inwardly out of the plane of upper side panels 16 and 20 to provide the surplus of material to enable the strap to be brought into a position of use. When in a deployed position, the composite flaps may act to stabilize or space the necks of articles contained within the carton thereby ensuring that the bottles or other articles are packed tightly within the carton. The sandwiching of the strap between the inner and outer displaceable tabs ensures that the strap is firmly secured to the carton. Top panel 86 of the insert substantially prevents the contents of the carton from being seen or accessed. Aperture H1 and H2 advantageously allow for the substantially unhindered displacement of the tabs.

The handle of a carton formed using insert blank 90 (not shown) is brought into use in a similar manner, although both the strip 92 and strap 79 form the user part.

In an alternative embodiment (not shown), to enable the carton to be carried more comfortably, a frangible user portion attached to top panel 18 may replace user aperture 74. The user portion may be secured to the strap 82 when insert 80 is secured to blank 10 using glue or other suitable means, and the user portion may be supplied with side cushioning flaps which fold underneath strap 82 to cushion the hand of the user.

Figure 6:
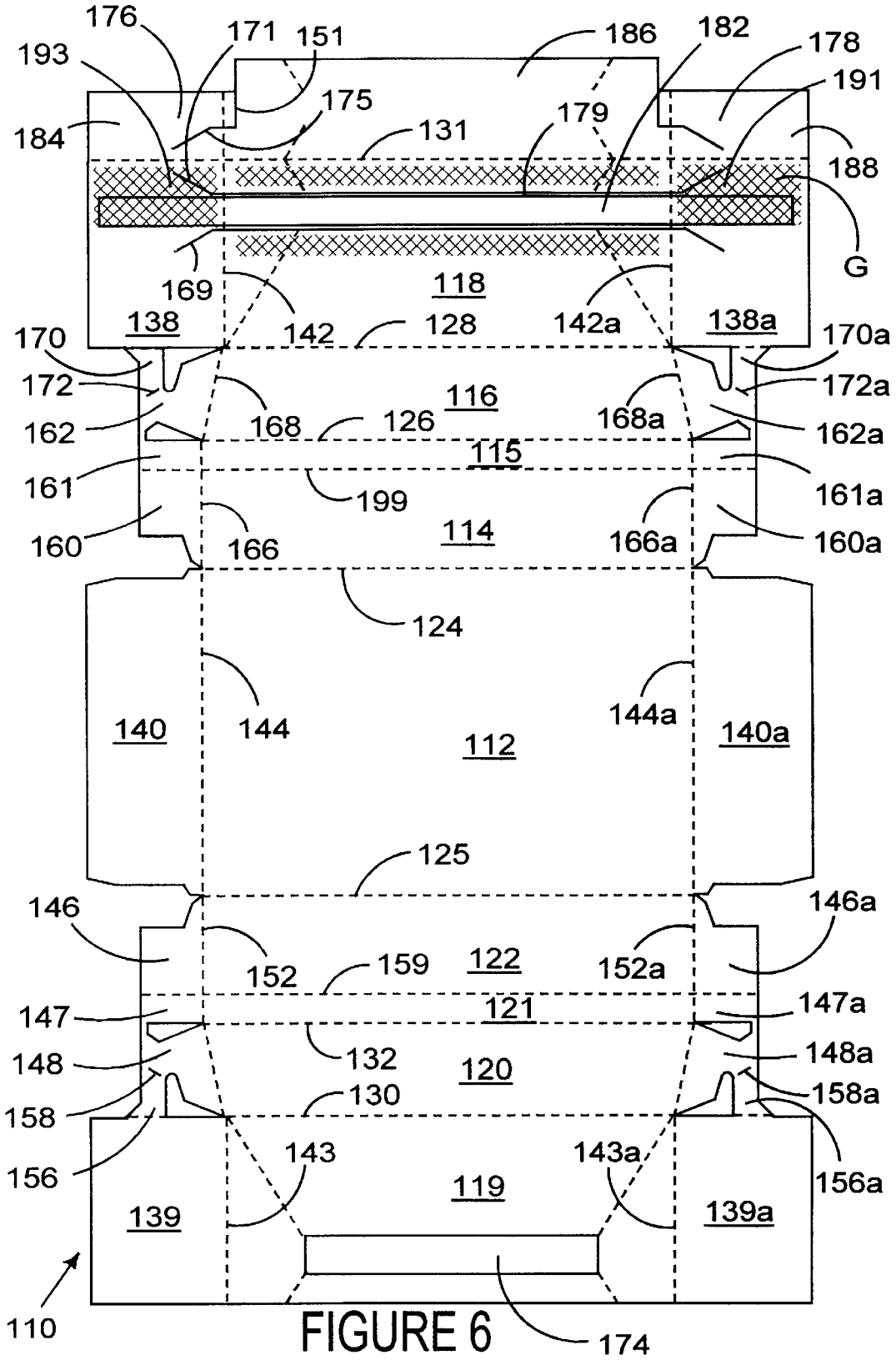
FIG. 6 is a plan view of a blank of a carton according to a second embodiment of the invention.
Figure 7:
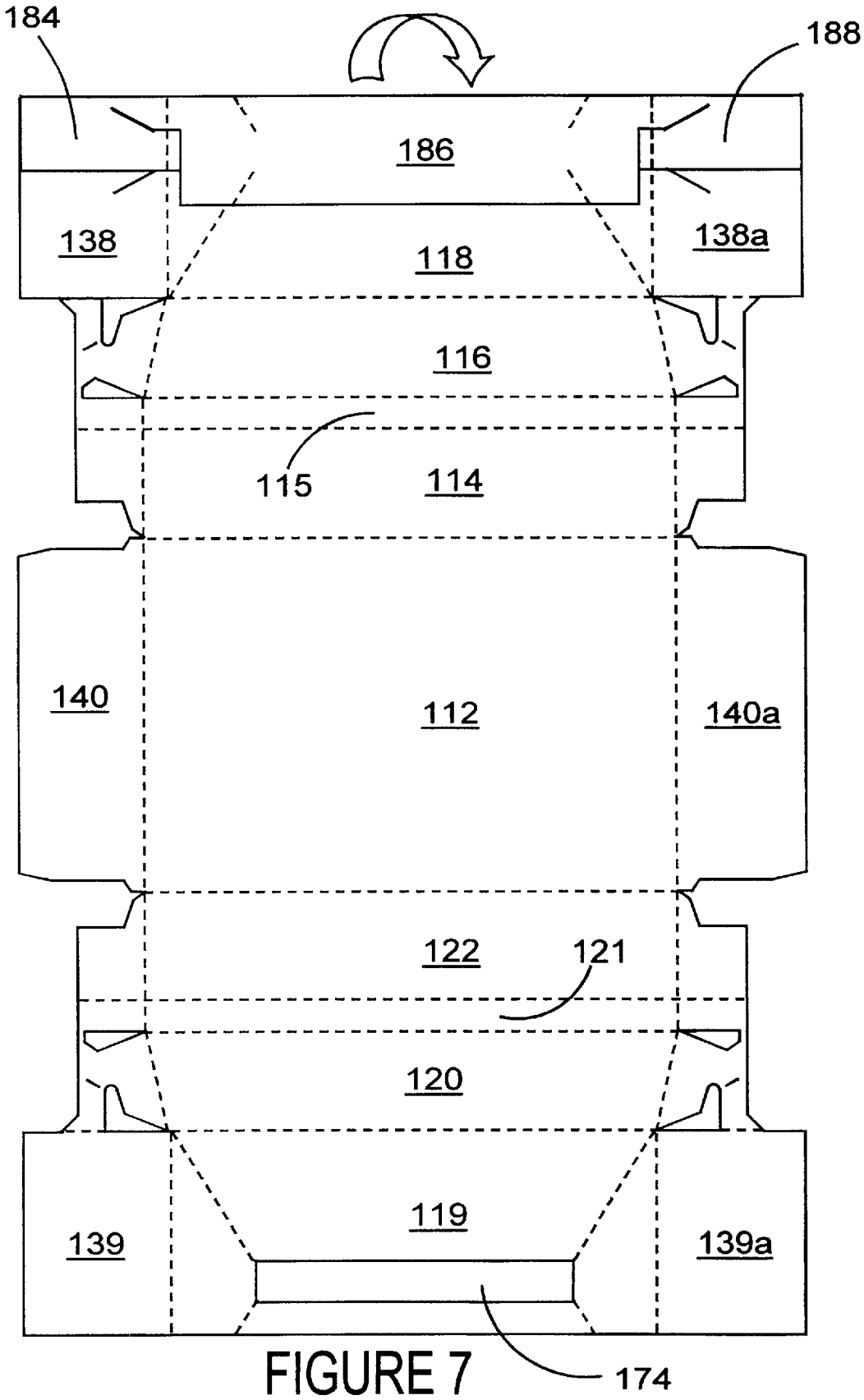
FIG. 7 is a plan view of the blank shown in FIG. 6 that has been partially folded.

The second embodiment shown in FIGS. 6 and 7 corresponds substantially to the first embodiment and therefore like parts are designated by reference numerals which are prefixed with the numeral "1". Only those parts of the second embodiment which differ from the first embodiment are hereinafter described. Thus, in this embodiment, the tubular carton is formed by lapping a first top panel 118 with a second top panel 119 and first upper end closure panels 138, 138*a* with a second upper end closure panels 139, 139*a* hinged to second top panel along fold lines 143, 143*a*. This arrangement is used to assist the construction of the handle which, in this embodiment, is formed longitudinally with respect to the carton, rather than transversely, as in the first class of embodiments.

An elongate strip 179 is struck from first top panel 118 and is arranged to extend between fold lines 142 and 142*a* in a direction substantially parallel to fold line 128. The strip 179 is hingedly interconnected to an outer displaceable tab 193 struck from, and hingedly connected to, end closure panel 138, the tab 193 being defined by cut lines 169, 171 which converge towards strip 179. A similar tab 191 is provided in end closure panel 138*a*. A user aperture 174 arranged substantially parallel to fold line 130 is provided in second top panel 119.

A handle strap 182 is secured to strip 179, flaps 191 and 193, and preferably end closure panels 138 and 138*a* using glue or other suitable means known in the art. The strap 182 preferably acts to reinforce strip 179. Again, it is preferred that the handle strap is formed from paperboard, laminated paperboard, fibrous tape or other suitable plastics material.

An aperture cover or blinding panel 186 is hingedly connected to top panel 118 along fold line 131, and is further hingedly connected to strap cover panels 184 and 188 along extensions of fold lines 142 and 142*a*. The strap cover panels are additionally hingedly connected to end cover panels 138 and 138*a* along extensions of fold line 131. Inner displaceable tabs 176 and 178 are struck from strap cover panels 184 and 188 respectively. Tab 176 is defined by cut line 175 and 151 and is arranged, when cover panel 184 is folded, to substantially overly cut line 171. Preferably, cut line 151 is struck from panel 186. Displaceable tab 178 is similarly arranged.

As shown in FIG. 6, tabs 176 and 178 may extend partially into cover panel 186. The cover panel is further advantageously provided with score lines which, when the carton is erected, are substantially co-extensive with the score lines of the first and second top panels 118, 199. Glue is applied to glue areas G, and panels 186, 184 and 188 are folded through substantially 180 so as to overlie strap 182 and panels 118, 138 and 138*a*. In alternative embodiments, glue may be applied to panels 184, 186, 186*a*. The strap is thereby secured between composite tabs 176, 193 and 178, 191 at its ends, as illustrated in FIG. 7.

There may further comprise intermediate side wall panels 115 and 121 formed in first and second side walls and hingedly connected thereto along fold lines 126, 199 and 159, 132 respectively. This allows the carton to be held in a flat collapsed condition about fold lines 199 and 159.

Turning now to the construction of the carton with reference in particular to FIG. 7, the blank is folded such that top panel 119 overlies top panel 118, and is secured thereto using glue or other known means, the panel being arranged such that strip 179, as reinforced by strap 182, is visible through user aperture 174. First and second upper end closure panels 138, 139 and 138*a*, 139*a* may also be secured together. The carton is now in a flat collapsed condition, as it would usually be supplied to a bottler.

Figure 8:
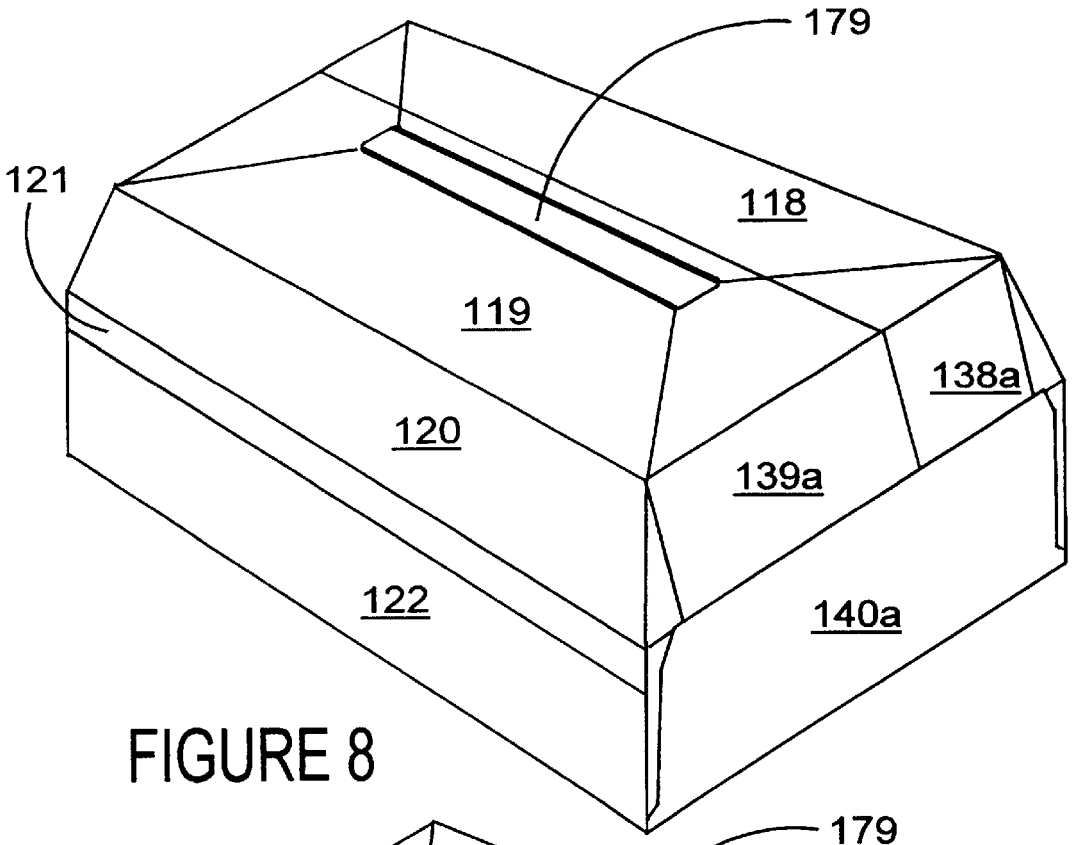
FIG. 8 is a perspective view of a carton formed from the blank shown in FIG. 6.
Figure 9:
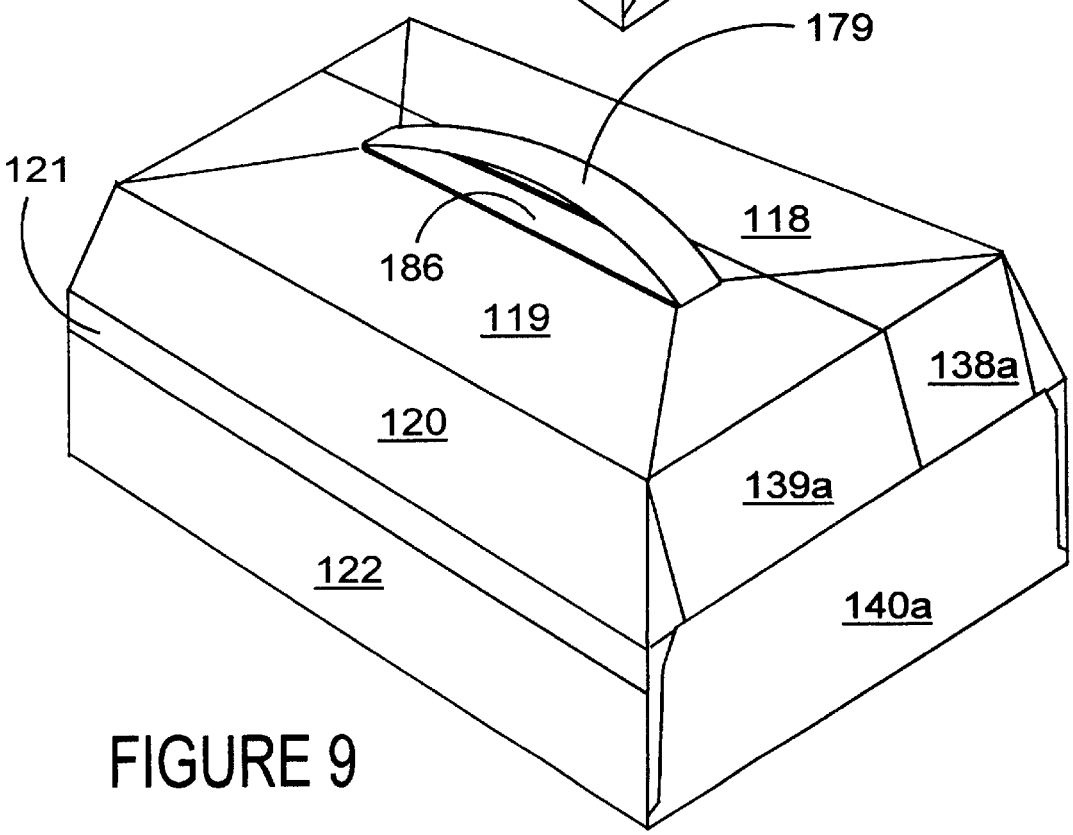
FIG. 9 is a perspective view of the carton shown in FIG. 8 illustrating the handle structure in a set up condition.

Thereafter, the construction of the carton is substantially identical to the construction of the carton as illustrated in the first embodiment. The fully erected carton is illustrated in FIG. 8. One advantage of this embodiment is that the outer displaceable tabs 191 and 193 are not visible from the exterior of the carton, as they are covered by upper end closure panels 139 and 139*a* respectively.

As in the first embodiment, the composite strip and strap handle may be engaged by the user and lifted out of the plane of composite top wall panel 118 and 119 so as to stand proud thereof. Inner and outer displaceable tabs 191, 193, 176, 178 are displaced inwardly to provide surplus material for the strap to be brought into a position of use. Cover panel 186 substantially prevents the contents of the carton being seen or accessed. The score lines provided in the top panels aid the distribution of the load from the handle to the carton walls.

Figure 10:
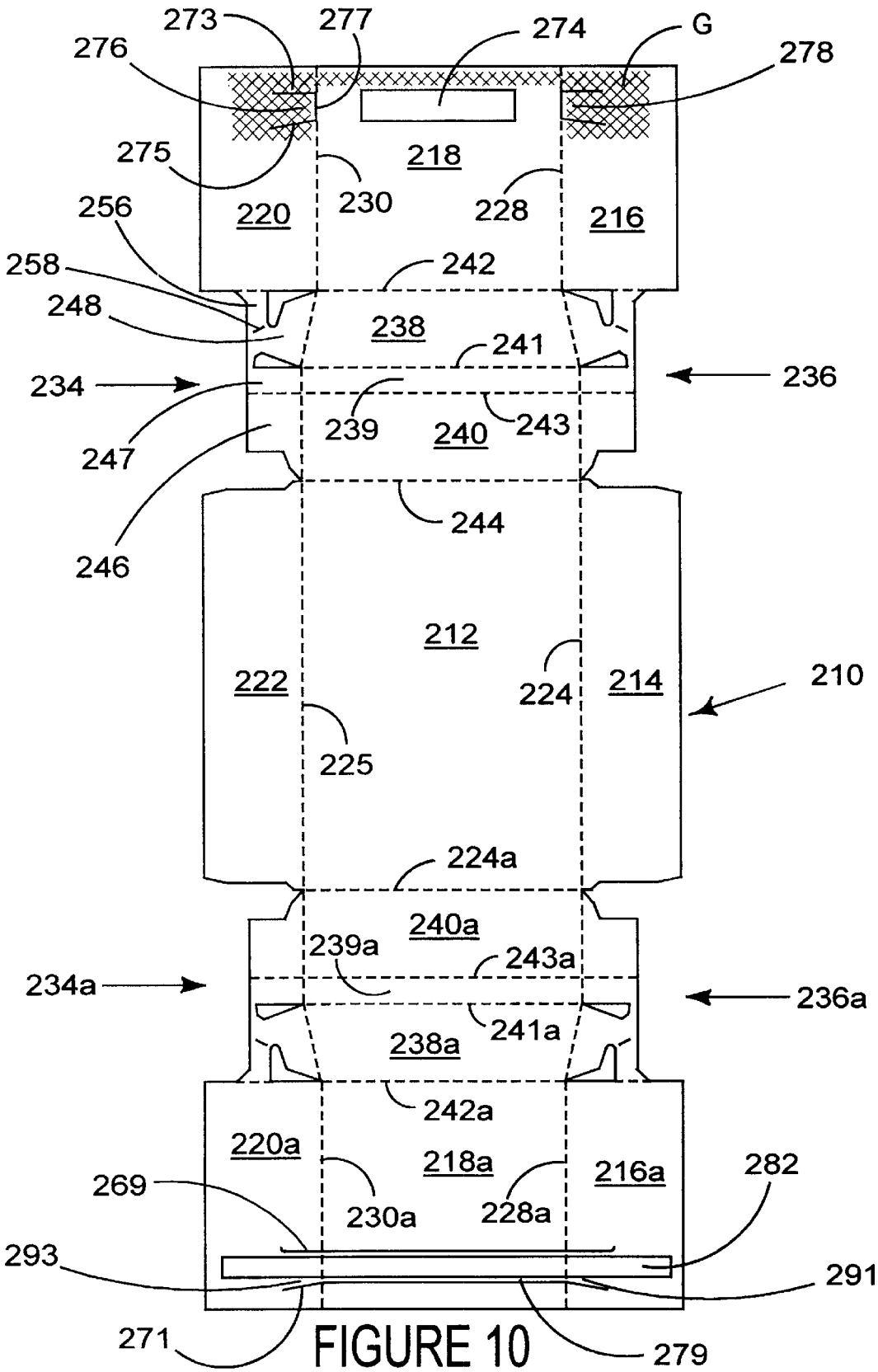
FIG. 10 is a plan view of a blank for a carton according to a third embodiment of the invention.
Figure 11:
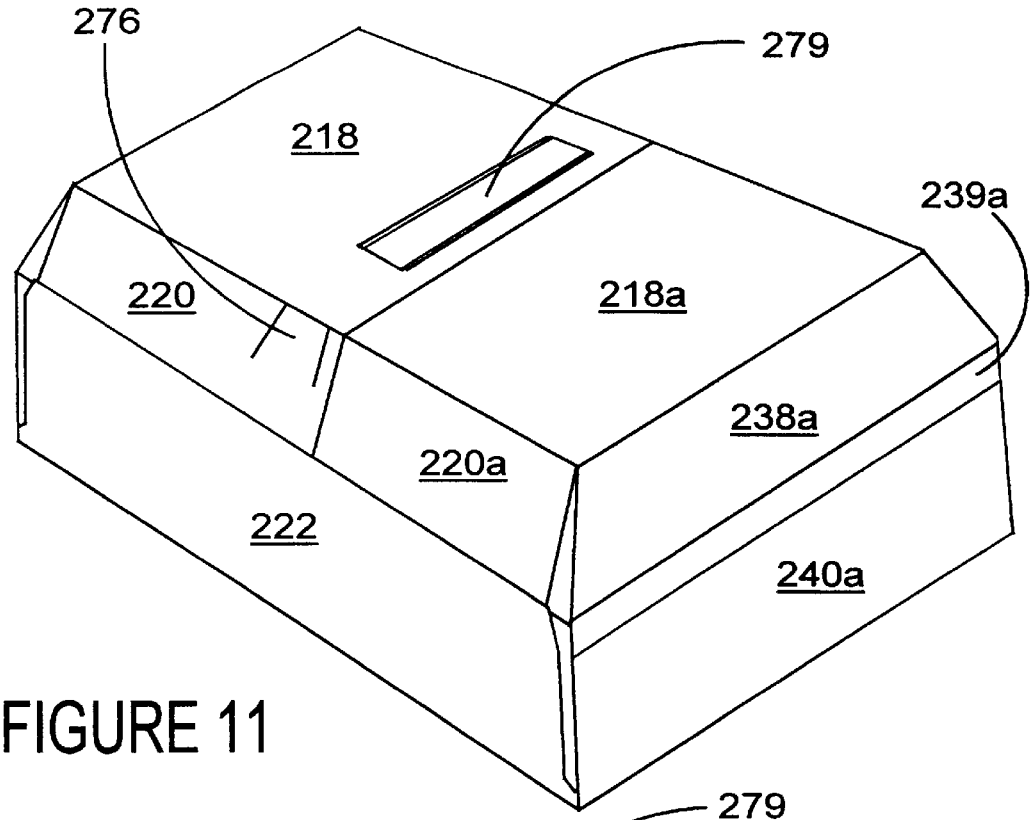
FIG. 11 is a perspective view of a carton formed from the blank shown in FIG. 10.
Figure 12:
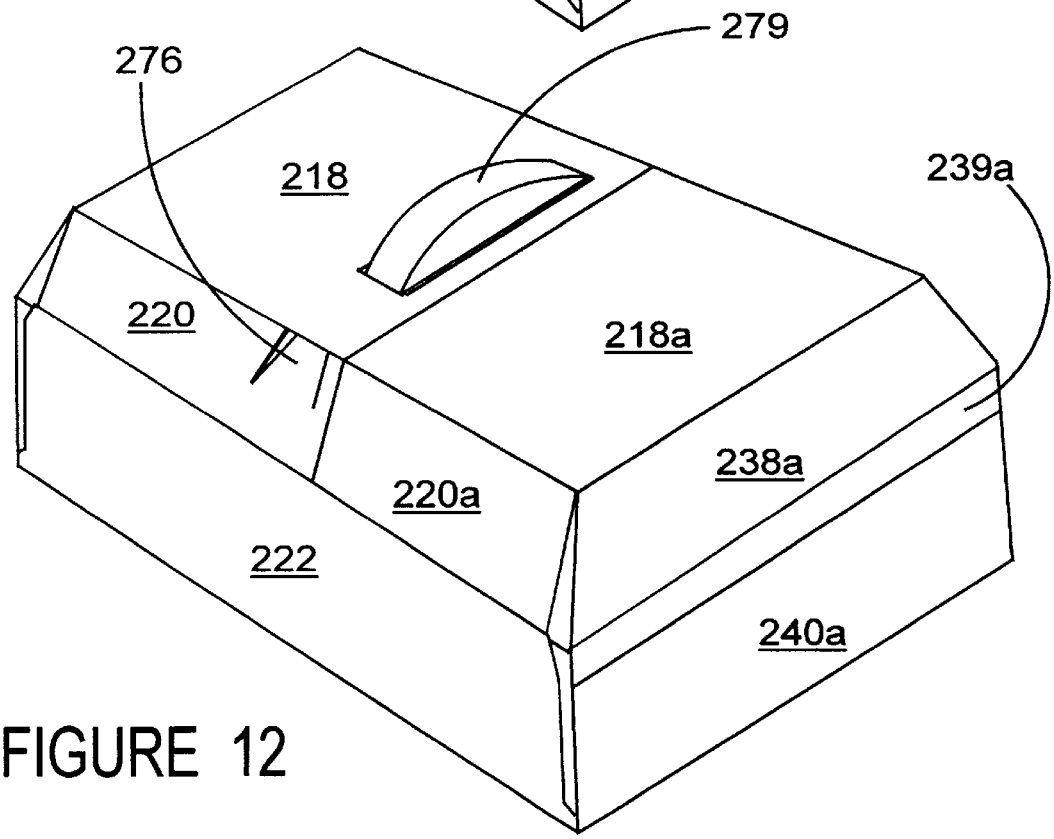
FIG. 12 is a perspective view of the carton shown in FIG. 11 illustrating the handle structure in a set up condition.

The third embodiment shown in FIGS. 10 to 12 corresponds substantially to the first and second embodiments in many respects and therefore, where possible, like parts are designated by numerals which are prefixed with the numeral "2". The most significant difference being that the top panels 218, 218*a* are lapped transversely such that the handle may also be constructed transversely.

Turning to the carton blank 210 illustrated in FIG. 10, this blank includes a first top panel 218, first upper end panel 238, first intermediate end panel 289, lower end panel 240, first base panel 212, second lower end panel 240*a*, second intermediate end panel 239*a*, second upper end panel 238*a*, and second top panel 218*a* hingedly interconnected in series along fold lines 242, 241, 243, 244, 244*a*, 243*a*, 241*a*, 242*a* respectively.

The blank further comprises one or more side closure structures including first and second upper side closure panels 220, 220*a* and 216, 216*a* hingedly connected to first and second top panels 218, 219 along fold lines 230, 230*a* and 228, 228*a* respectively. In this embodiment, the side closure structures also include lower side closure panels 222, 214 hingedly connected to base panel 312 by fold lines 225, 224 respectively formed along the opposed longitudinal edges of base panel 312.

The side closure structure may also include gusset arrangements 234, 234*a* and 236, 236*a* that are substantially identical to the end gusset arrangements of the previous two embodiments above, and will not therefore be discussed in greater detail.

A handle arrangement similar to that of the second embodiment is provided in this embodiment. In this embodiment, however, the handle strap extends transversely across the top panel, rather than longitudinally. Furthermore, no blinding panel or strap cover panels are provided, although it is envisaged that in alternative embodiments these panels could be provided.

An elongate strip 279 is struck from second top panel 218*a* and is arranged to extend between fold lines 228*a* and 230*a* in a direction substantially parallel to fold line 242*a*. The strip 279 is hingedly interconnected to an inner inwardly displaceable tab 293 struck from, and hingedly connected to, side closure panel 220*a*, the tab 293 being defined by cut lines 269, 271 which may preferably converge towards strip 279. A similar tab 291 is provided in side closure panel 216*a*.

Optionally, a handle strap 282 is provided to be secured to strip 279, tabs 291 and 293 and, preferably, side closure panels 220*a* and 216*a* using glue or other suitable means. Again, it is preferred that the handle strap is formed from paperboard, laminated paperboard, fibrous tape or other suitable plastics material.

Outer displaceable tabs 276 and 278 are struck from first upper side closure panels 220 and 216 respectively. Tab 276 is defined by cut lines 275 and 273 and 277 and is arranged to substantially overlie tab 293 when the blank is folded to form a flat tubular structure. Displaceable tab 278 is similarly arranged to overlie tab 291. A user aperture 274 is arranged substantially mid-way between tabs 276 and 278.

Turning now to the construction of the carton in FIGS. 10 and 11 the blank is folded such that first top panel 218 overlies second top panel 218*a*, and is secured thereto by glue at glue points G (FIG. 10) or other suitable means, such that elongate strip 279, as reinforced by strap 282, is accessible through aperture 274. In addition, tab 276 overlies tab 293, and tab 278 overlies tab 291. In this embodiment, the tabs do not sandwich the ends of the strap 282 as in the previous embodiments although it is envisaged that these could be sandwiched between the tabs without departing from the scope of the invention.

The carton is usually supplied to a bottler in this flat collapsed form. The carton is subsequently loaded and erected and the side closure structures are formed in a similar manner to the end closure structures of the previous embodiment. The carton is now fully erected, as illustrated in FIG. 11.

In order to form the handle as illustrated in FIG. 12, the elongate strip 279 is accessed via the user aperture 274, and may be pulled so as to stand proud of the composite top wall 218, 218*a*. Composite tabs 276, 293 and 278, 291 deflect inwardly out of the plane of the upper side panels to provide the surplus of material to enable the strap to be brought into a position of use.

Turning now to FIGS. 13 to 16, there is illustrated a fourth embodiment of the invention which is a variation on the second embodiment of FIGS. 6 to 9 in which the handle structure is provided on a side wall of the carton rather than the top. As the fourth embodiment corresponds substantially to the second embodiment, like parts are designated by like reference numerals which are prefixed with the number "3" and only those parts of the fourth embodiment which differ from the second embodiment are hereinafter described.

Figure 13:
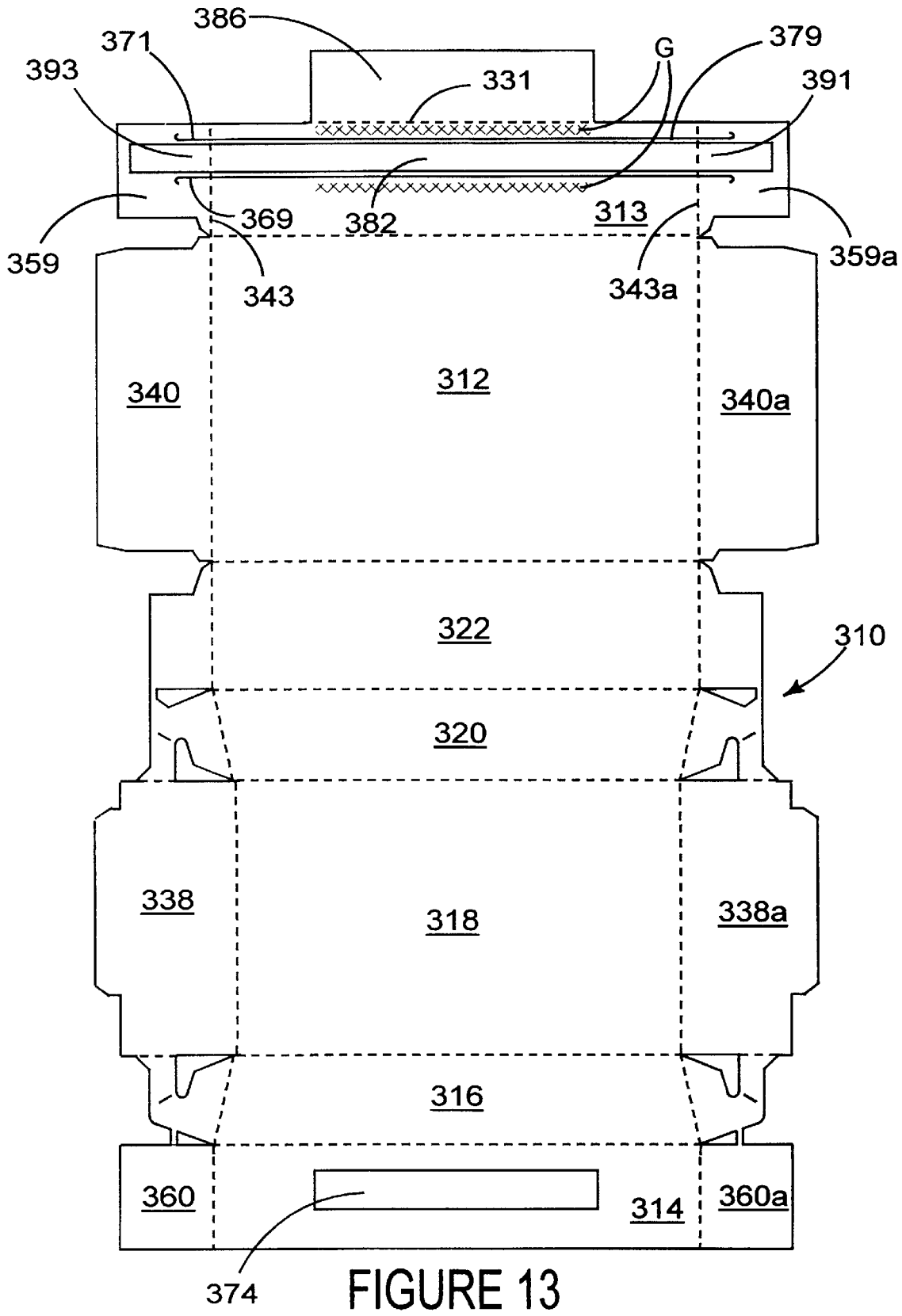
FIG. 13 is a plan view of a blank according to a fourth embodiment of the invention.

Referring now in particular to FIG. 13, there is shown a blank 310 comprising in series a first lower side panel 313, base panel 312, second lower side panel 322, first upper side panel 320, top panel 318, second upper side panel 316 and third lower side panel 314.

An elongate strip 379 is struck from first lower side panel 313 and is arranged to extend between fold lines 343 and 343*a* in a direction substantially parallel to the end edge of the blank. The strip 379 is hingedly interconnected to an inner inwardly displaceable tab 393 struck from and hingedly connected to end closure panel 359, the tab 393 being defined by cut lines 369 and 371 which in this embodiment are preferably parallel, and terminate in stress relieving curved portions. A similar inner tab 391 is provided in end closure panel 359*a*.

Optionally, a handle strap 382 is provided to be secured to the strip 379, tabs 393 and 391 and, preferably, end closure panels 359 and 359*a* using glue or other suitable means. The handle strap is preferably formed from one of the materials described in the previous embodiments. A blinding panel 386 is advantageously further hingedly connected to first lower end panel 313 along fold line 131. A user aperture 374 preferably extends transversely across third lower side panel 314.

Figure 14:
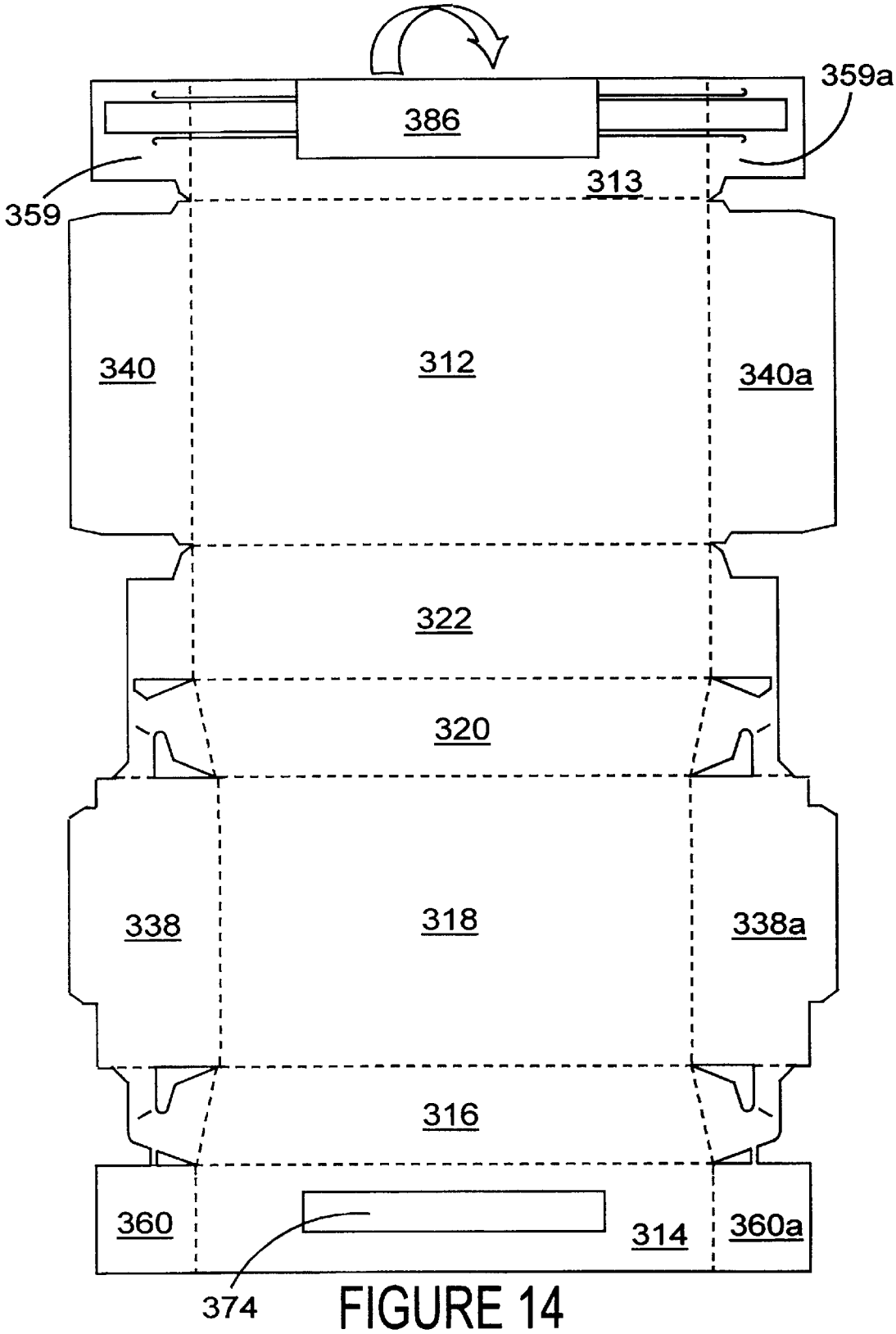
FIG. 14 is a plan view of the blank of FIG. 13 that has been partially folded.

Glue is applied to glue points G and the blinding panel is folded in a direction indicated by the arrow in FIG. 14 so as to overlie the elongate strip 379 and strap 382 along at least a portion of their length. The blinding panel is preferably of greater length than user aperture 374.

To construct the carton, the blank is folded such that third lower side panel 314 overlies first lower side panel 313, the panels being secured together using glue or other known means such that the elongate strip 379 can be accessed through user aperture 374.

Figure 15:
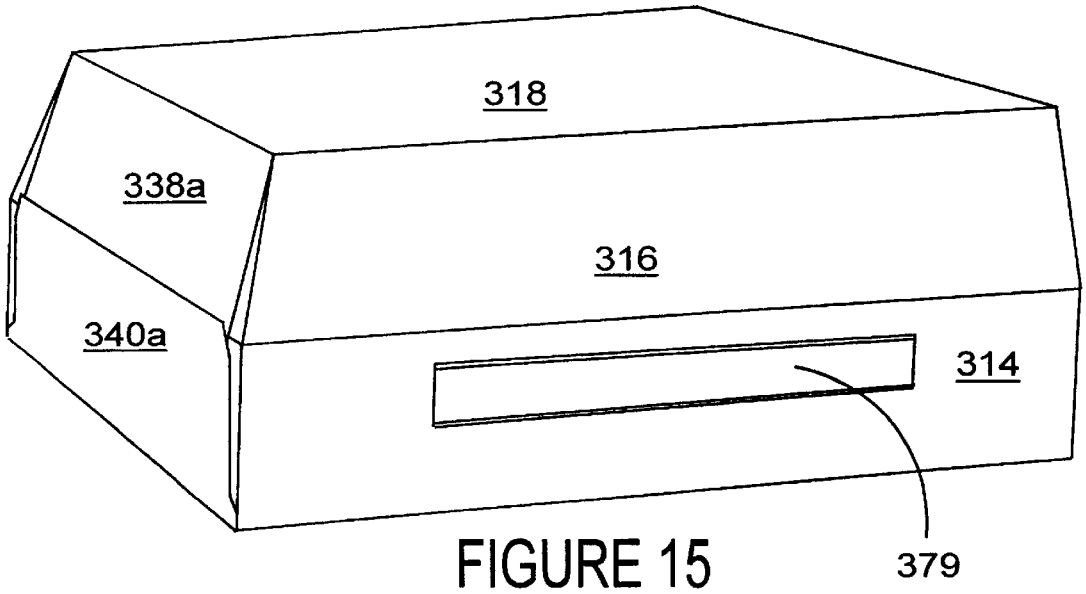
FIG. 15 is a perspective view of a carton formed from the blank of FIG. 13.

The carton is usually supplied to a bottler in this flat tubular form. The carton is subsequently erected and loaded and the side closure structures are formed in a similar manner to the end closure structures of the second embodiment. The carton is now fully erected as illustrated in FIG. 15.

Figure 16:
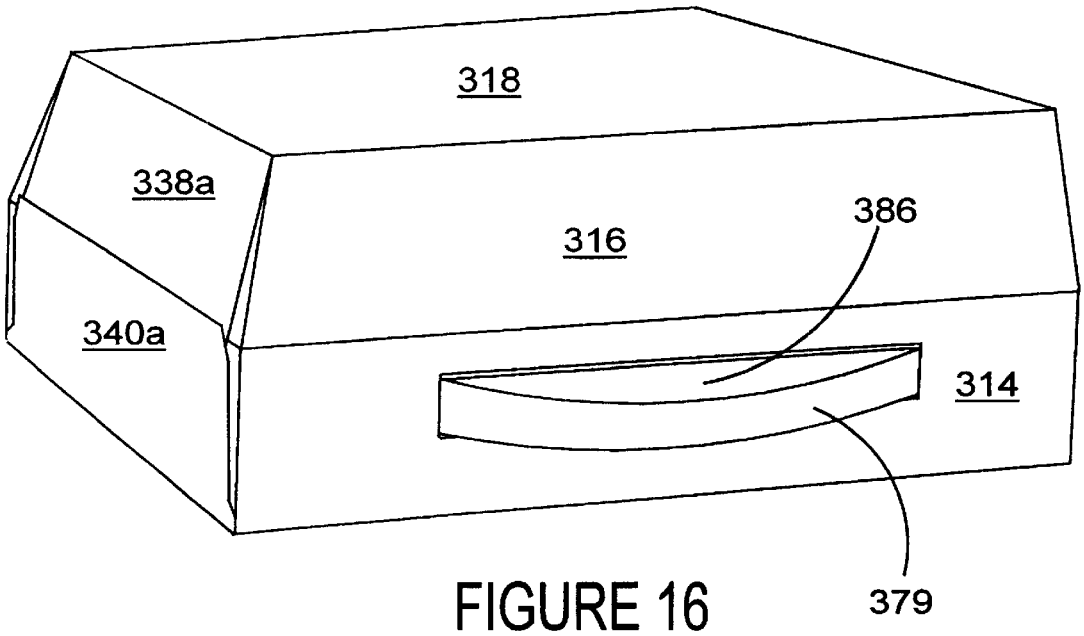
FIG. 16 is a perspective view of the carton shown in FIG. 15 illustrating the handle structure in a set up condition.

The elongate reinforced strap 379 may be engaged by the user as in the previous embodiments, with the surplus strap material being provided by the inward displacement of tabs 371 and 391 shown in FIG. 16. The tabs are however hidden from view by panels 360 and 360*a* of the end closure structure. Blinding panel 386 substantially prevents the contents of the carton being viewed and accessed once the reinforced strap 379 is deployed.

The fifth embodiment shown in FIGS. 17 to 20 correspond substantially to the second embodiment therefore like parts are designated by like reference numerals which are prefixed with the numeral "4". Only those parts of the fifth embodiment which differ from the second embodiment are hereinafter described. Thus, in this embodiment the tubular carton is formed by lapping first top panel 418 with second top panel 419 and first upper end closure panel 438, 438*a* with a second upper end closure panel 439, 439*a*. This lapping arrangement is used to assist in the construction of the handle.

Outer inwardly displaceable tab 493 is struck from the end edge of panel 439 and, optionally, panel 419, is defined by cut lines 469 and 477 and preferably straddles fold line 443, to terminate at cut line 477. Cut line 469 advantageously terminates in a stress-relieving curved portion. A similar tab 491 is struck from panels 439*a* and optionally panel 419. A blinding panel 479 hingedly interconnects to second top panel 419 along fold line 489 is provided intermediate outer displaceable tabs 491 and 493 and is separated therefrom by cut lines 477 and 477*a*.

A similar arrangement comprising inner inwardly displaceable tabs 476 and 478 are provided on the first top panel 418 and upper end closure panels 438 and 439. Further panels 495 and 497 are preferably hingedly connected to the free ends of the inner tabs 476 and 478*a* along fold lines 493, 493*a*. A blinding panel 486 is preferably formed integrally with first top panel 418 which is hingedly connected to blinding panel along fold lines 491, 491*a*. In alternative classes of embodiments, panels 495, 497 are replaced by apertures similar to the embodiment of FIG. 1B.

Figures 18A, 18B, 18C, 18D:
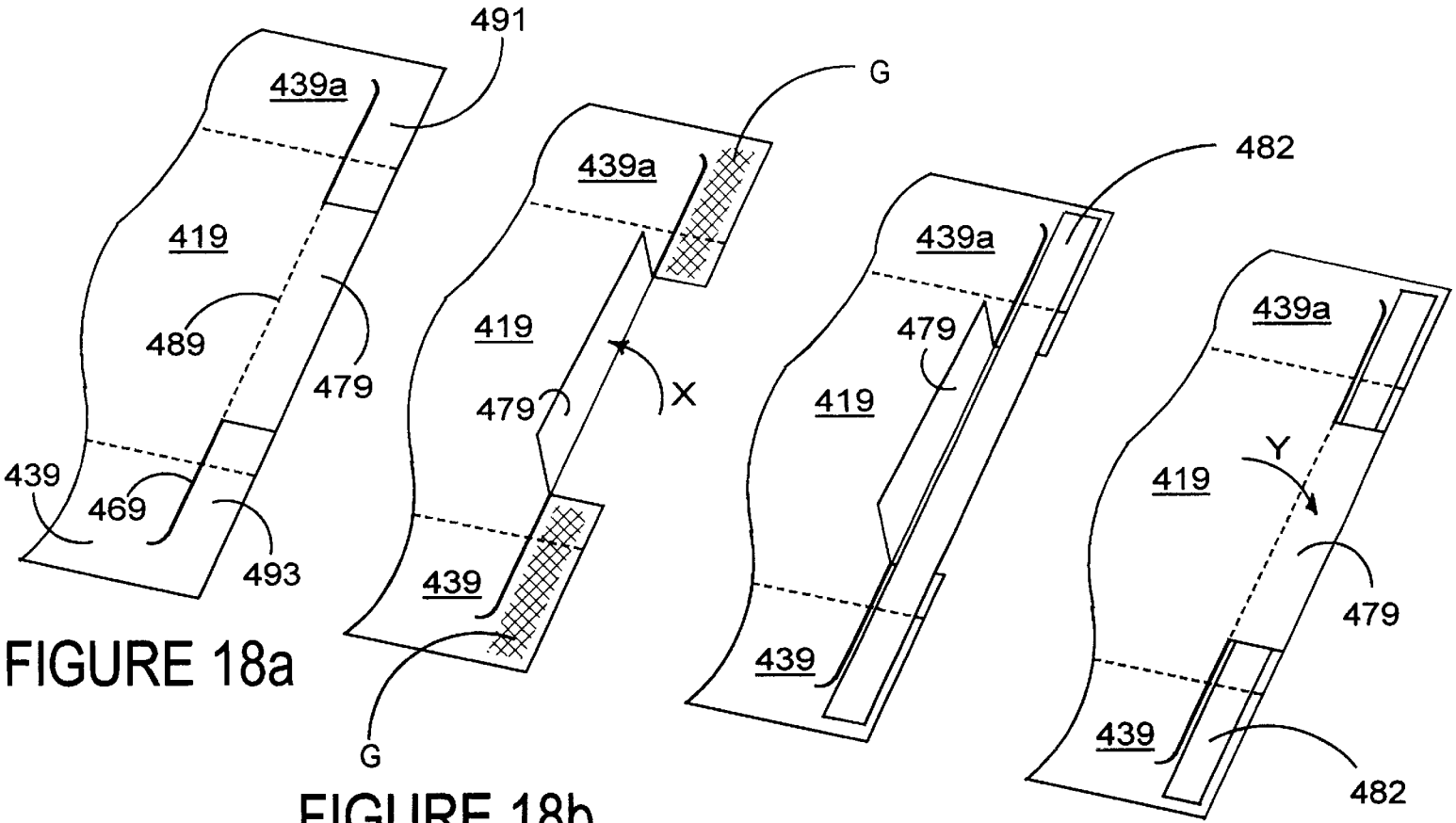
FIGS. 18*a*, 18*b*, 18*c* and 18*d* are perspective views of a folding and securing operation relating to one portion of the blank of FIG. 17.

Referring now to FIGS. 18*a*, 18*b*, 18*c* and 18*d* there is shown a sequence of steps for securing a handle strap 482 to the blank. It can be seen from FIG. 18B that blinding panel 479 is folded out of alignment in direction "X" from second top panel 419 and glue is applied to glue points G on tabs 491 and 492 and panels 439 and 439*a*. The strap 482 is then preferably secured to the blank as shown in FIG. 18C. To complete the operation, blinding panel 479 is folded in direction "Y" back into substantial alignment with second top panel 419 as illustrated in FIG. 18*d*.

Figure 17:
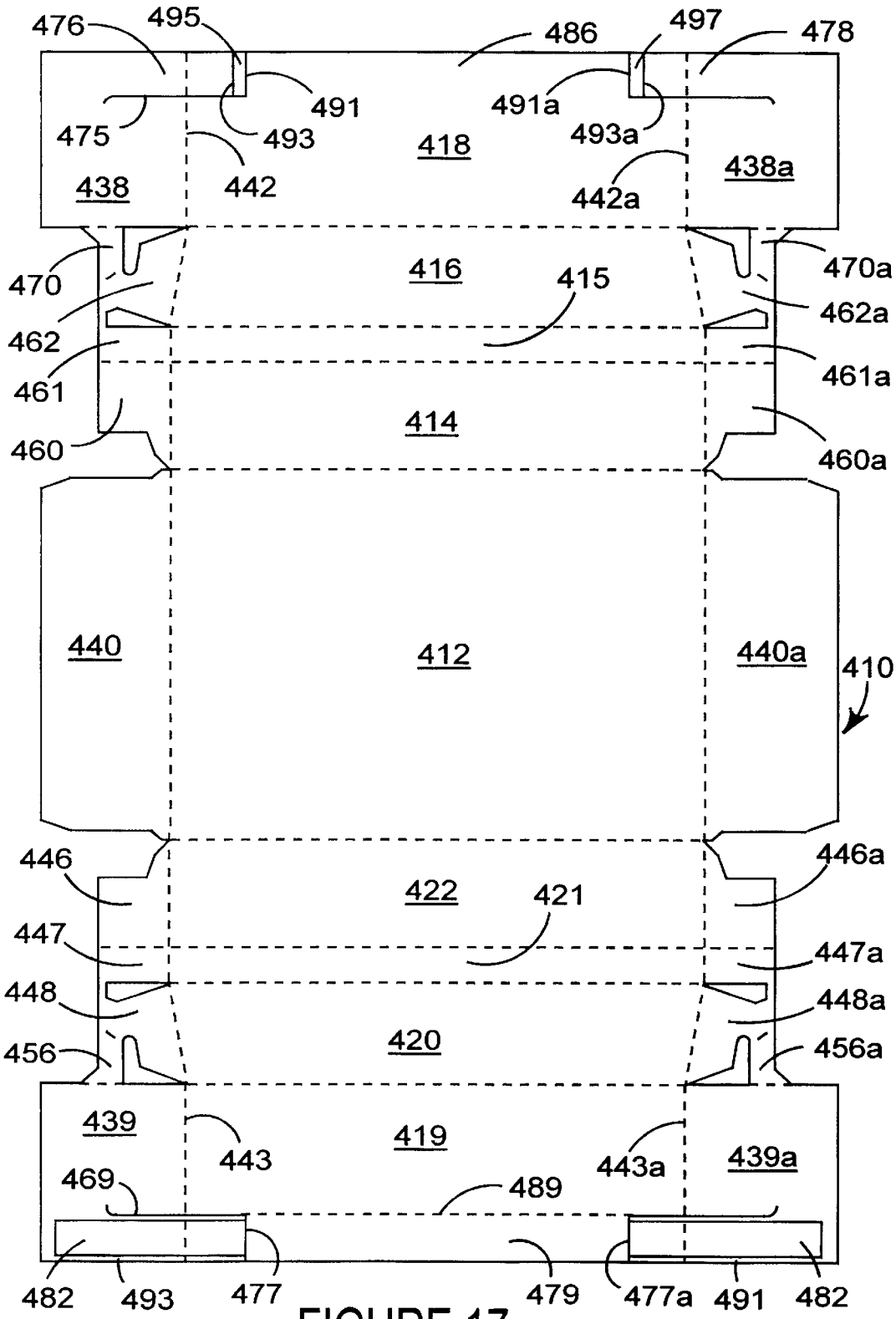
FIG. 17 is a plan view of a blank according to a fifth embodiment of the invention.
Figure 19:
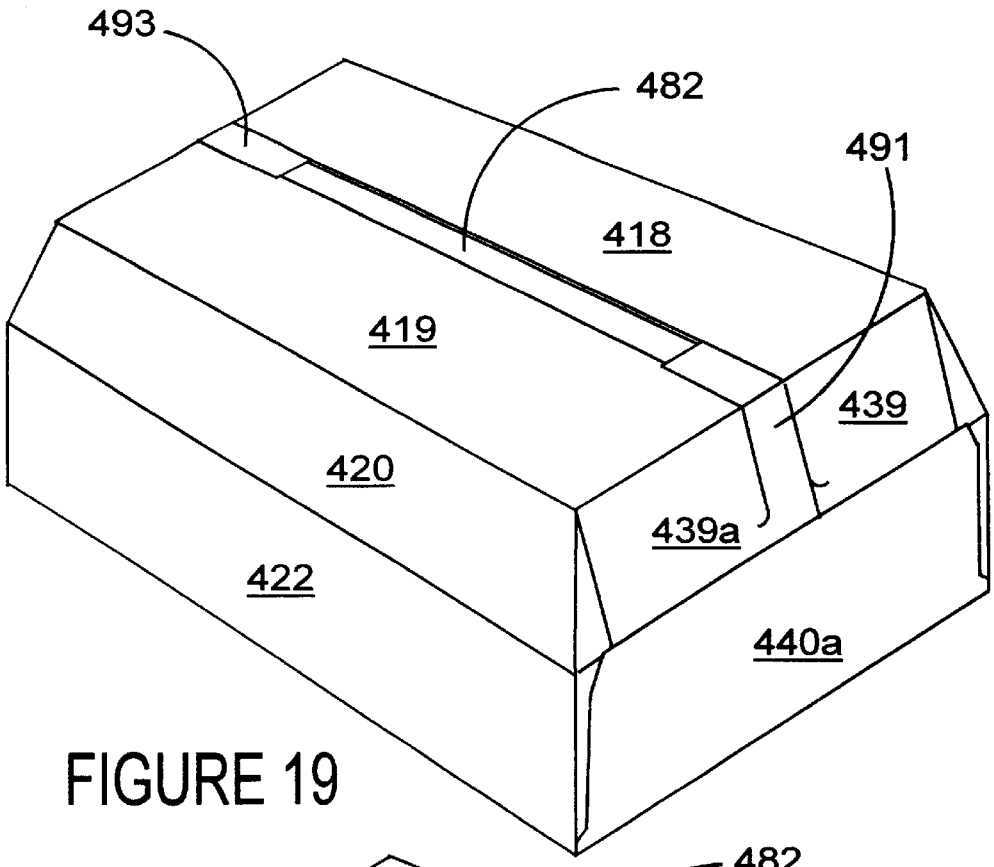
FIG. 19 is a perspective view of a carton formed from the blank of FIG. 17.

To form a fully erected carton as illustrated in FIG. 19, the blank of FIG. 17 is folded such that blinding panel 479 overlies blinding panel 486 and is secured thereto using glue or other suitable means, and that the strap 482, tabs 491 and 493, and optionally end closure panels 439 and 439*a* overlie tabs 476 and 478, panels 495 and 497 and end closure panels 438 and 438*a*, and are secured thereto such that tab 476 is substantially in register with tab 493, and tab 478 is substantially in register with tab 491. Handle strap 482 is secured therebetween in this embodiment.

Once the carton has been loaded, and the ends closed and secured, the carton is fully erected as illustrated in FIG. 19.

Figure 20:
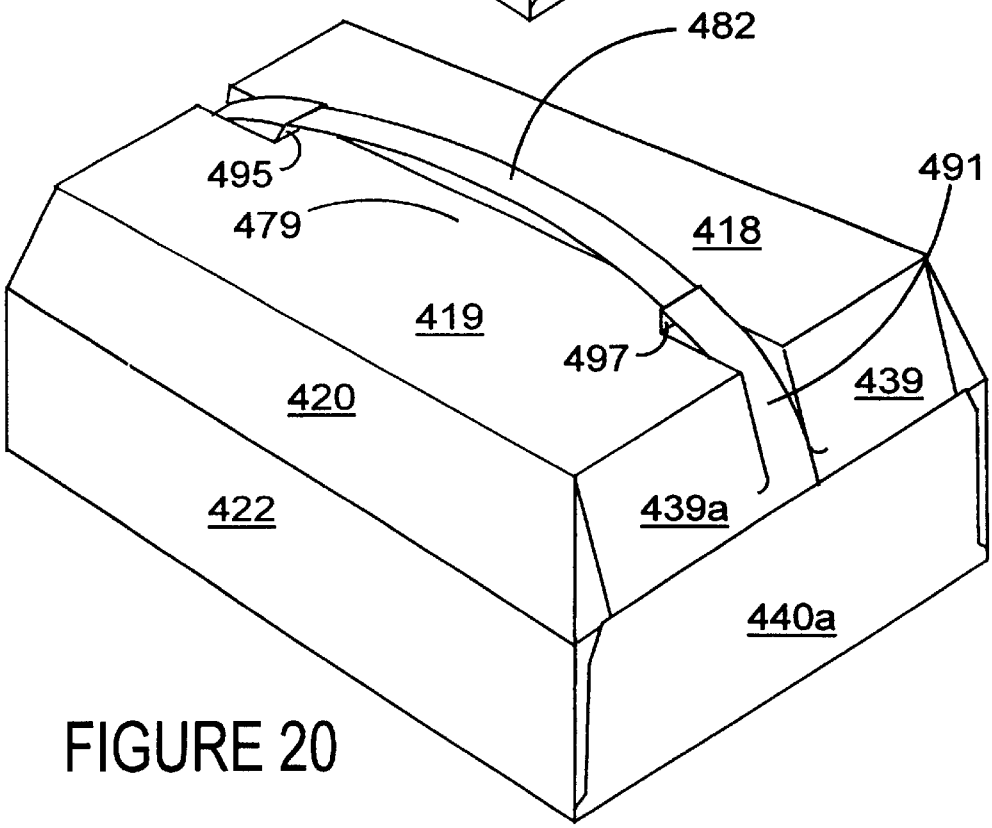
FIG. 20 is a perspective view of the carton shown in FIG. 19 illustrating the handle structure in a set-up condition.

Referring now to FIG. 20, to lift the carton, an end user engages strap 482 such that the composite tabs 476, 493 and 478, 491 thereby providing a surplus of material to enable strap 482 to stand proud of the composite top wall 418, 419. The composite blinding panel formed by panels 486 and 479 enhances the structural integrity of the carton, as well as substantially preventing the contents of the carton being viewed. Also, panels 495, 497 improve rigidity of the carton.

It is envisaged that the inwardly displaceable portion of flaps 76, 78 are adapted to be placed intermediate adjacent articles to separate and support these bottles. Furthermore, the abutment of the flaps against the articles will encourage the handle to be maintained in a deployed position so that it can be re-used easily. A further advantage is that the handles do not protrude when in a stored position so that prior to use they do not tear or snag other cartons placed on top or around it.

It will be recognized that as used herein, directional references such as "top", "base", "upper", "lower", "intermediate", "end", and "side" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

It will further be recognised that in the construction of the cartons of the embodiments described, the blanks require a series of sequential folding and gluing operations which are preferably performed in a straight line machine so that the cartons are not required to be rotated or inverted to complete their construction. The folding process is not limited to those described above and can be altered according to particular manufacturing requirements.

It should be understood that numerous changes may be made within the scope of the invention, for example the size and shape of the panels may be adjusted so as to package articles of various sizes. Alternative known end/side closure means may be used, and user apertures in those embodiments where they are present may be replaced by user panels which may be secured to the strip/strap so as to provide cushioning for the hand of the end user.

Furthermore, the carton and handle structures of the present invention are shaped to provide satisfactory rigidity to hold items such as bottles securely, but with a degree of flexibility so that the load from the handle, when the carton is carried, can be better absorbed by it. The shape of the blank minimizes the amount of paperboard required. The articles can be applied to the carton by hand or automatic machinery.

What is claimed is:

1. A carton for accommodating at least one article, the carton comprising a first wall, a second wall hingedly connected to the first wall, a first inwardly displaceable portion formed from the second wall, a handle strap attached at least one end thereof to the first inwardly displaceable portion for movement between a stored position where the handle strap is disposed in substantially co-planar relationship with the first wall and a position of use where the handle strap is raised relative to the first wall, the first inwardly displaceable portion being joined to the second wall for inward displacement relative to the carton when the handle strap is raised into the position of use, whereby providing a surplus of material to enable the handle strap to be brought into the position of use, wherein the carton further comprises a second inwardly displaceable portion formed from a ply of material overlying at least a part of the first inwardly displaceable portion, the second inwardly displaceable portion being in substantial registry with the first inwardly displaceable portion, said one end of the handle strap being secured together with the first and second inwardly displaceable portions.

2. A carton according to claim 1 wherein the first inwardly displaceable portion is a tab struck from the second wall.

3. A carton according to claim 2 wherein the tab is defined by cut lines that intersect with a fold line hingedly interconnecting the first and second walls.

4. A carton according to claim 1 wherein said one end of the handle strap is disposed and secured between the first and second inwardly displaceable portions.

5. A carton according to claim 1 wherein the first inwardly displaceable portion is formed integrally with an elongate strip formed from, and extending across, the first wall.

6. A carton according to claim 5 wherein the handle strap is secured at least part of the elongate strip and coextensive therewith.

7. A carton according to claim 1 wherein the first wall is a composite of a pair of at least partially lapped panels.

8. A carton according to claim 1 wherein the ply of material comprises a separate insert to the carton.

9. A carton according to claim 1 wherein the ply of material is hingedly connected to the second wall.

10. A carton according to claim 1 wherein the first wall comprises a top wall of the carton and is formed with a handle aperture through which the handle strap is accessed, and the ply of material comprises a blinding panel underlying the handle panel for substantially preventing further access to the interior of the carton through the handle aperture.

11. A blank for forming a carton for accommodating at least one article, the blank comprising a first panel, a second panel hingedly connected to the first panel, a first inwardly displaceable portion formed from the second panel, a handle strap attached at least one end thereof to the first inwardly displaceable portion for movement between a stored position where the handle strap is disposed in substantially co-planar relationship with the first panel and a position of use where the handle strap is out of a plain of the first panel, the first inwardly displaceable portion being joined to the second panel for displacement relative to the second panel when the handle strap is moved into the position of use, whereby providing a surplus of material to enable the handle strap to be brought into the position of use, wherein the blank further comprises a second inwardly displaceable portion formed from a ply of material overlying at least a part of the first inwardly displaceable portion, the second inwardly displaceable portion being in substantial registry with the first inwardly displaceable portion, said one end of the handle strap being secured together with the first and second inwardly displaceable portions.

12. A blank according to claim 11 wherein the first inwardly displaceable portion is a tab struck from the second panel.

13. A blank according to claim 12 wherein the tab is defined by cut lines that intersect with a fold line hingedly interconnecting the first and second panels.

14. A blank according to claim 11 wherein said one end of the handle strap is disposed and secured between the first and second inwardly displaceable portions.

15. A blank according to claim 11 wherein the first inwardly displaceable portion is formed integrally with an elongate strip formed from, and extending across, the first panel.

16. A blank according to claim 15 wherein the handle strap is secured at least part of the elongate strip and coextensive therewith.

17. A blank according to claim 11 wherein the ply of material comprises a separate panel attached to the blank.

18. A blank according to claim 11 wherein the ply of material is hingedly connected to the second panel.

19. A blank according to claim 11 wherein the first panel is formed with a handle aperture through which the handle strap is accessed, and the ply of material comprises a blinding panel attached to the first panel so that the handle strap is interposed between the first panel and the blinding panel and that the blinding panel substantially closes the handle aperture.

* * * * *